US012502048B2

(12) United States Patent
Dodgson

(10) Patent No.: US 12,502,048 B2
(45) Date of Patent: Dec. 23, 2025

(54) FLOOR CLEANER DOCK

(71) Applicant: Dyson Technology Limited, Wiltshire (GB)

(72) Inventor: Oliver Dodgson, Swindon (GB)

(73) Assignee: Dyson Technology Limited, Wiltshire (GB)

( * ) Notice: Subject to any disclaimer, the term of this patent is extended or adjusted under 35 U.S.C. 154(b) by 0 days.

(21) Appl. No.: 18/278,675

(22) PCT Filed: Feb. 22, 2022

(86) PCT No.: PCT/GB2022/050490

§ 371 (c)(1),
(2) Date: Aug. 24, 2023

(87) PCT Pub. No.: WO2022/180387

PCT Pub. Date: Sep. 1, 2022

(65) Prior Publication Data

US 2024/0138646 A1 May 2, 2024

(30) Foreign Application Priority Data

Feb. 26, 2021 (GB) ..... 2102784

(51) Int. Cl.
*A47L 11/40* (2006.01)

(52) U.S. Cl.
CPC ..... *A47L 11/4091* (2013.01); *A47L 11/4005* (2013.01); *A47L 11/4016* (2013.01); *A47L 11/4027* (2013.01); *A47L 11/4083* (2013.01)

(58) Field of Classification Search
CPC ..... A47L 11/4091; A47L 11/4005; A47L 11/4016; A47L 11/4027; A47L 11/4083
See application file for complete search history.

(56) References Cited

U.S. PATENT DOCUMENTS

| | | | |
|---|---|---|---|
| 9,119,518 | B2 | 9/2015 | Hruby |
| 9,775,485 | B2 | 10/2017 | Scholten et al. |
| 2006/0130272 | A1 | 6/2006 | Oh et al. |
| 2015/0182089 | A1 | 7/2015 | Jeong et al. |
| 2017/0290486 | A1 | 10/2017 | Deng et al. |

(Continued)

FOREIGN PATENT DOCUMENTS

| | | |
|---|---|---|
| CN | 107811576 A | 3/2018 |
| CN | 105496308 B | 2/2019 |

(Continued)

OTHER PUBLICATIONS

Machine Translation of CN215650867U (Year: 2022).*

(Continued)

*Primary Examiner* — Sharidan Carrillo
(74) *Attorney, Agent, or Firm* — Tucker Ellis LLP

(57) ABSTRACT

A dock for receiving a floor cleaner with a cleaning head, the dock including a receiving unit for receiving the cleaning head of the floor cleaner, and a hair removal unit for removing hair from a cleaning head received by the receiving unit. The hair removal unit may take a number of forms, for example a cutter and/or hook, a toothed comb, or a tapered roller. The removal of hair from the cleaning head of the floor cleaner may improve or maintain cleaning performance, and/or improve the aesthetics of the floor cleaner during use.

13 Claims, 3 Drawing Sheets

(56) References Cited

U.S. PATENT DOCUMENTS

| | | | | |
|---|---|---|---|---|
| 2021/0030244 | A1 | 2/2021 | Won et al. | |
| 2021/0290025 | A1 * | 9/2021 | Finison | A47L 11/4005 |

FOREIGN PATENT DOCUMENTS

| | | | | |
|---|---|---|---|---|
| CN | 210095622 | U | 2/2020 | |
| CN | 108577696 | B | 9/2020 | |
| DE | 102018000083 | A1 | 7/2019 | |
| EP | 2407074 | A2 | 1/2012 | |
| FR | 3055789 | A1 | 3/2018 | |
| GB | 0389285 | A | 3/1933 | |
| GB | 2411107 | A | 8/2005 | |
| IN | 105595918 | B | 9/2018 | |
| JP | 2590544 | B2 | 3/1997 | |
| KR | 10-2001-0087031 | A | 9/2001 | |
| WO | WO-2007137234 | A2 * | 11/2007 | A47L 11/24 |
| WO | 2022/180385 | A1 | 9/2022 | |
| WO | 2022/180387 | A1 | 9/2022 | |

OTHER PUBLICATIONS

Examination Report received for GB Application No. 2102784.2, mailed on May 16, 2023, 1 page.
International Search Report and Written Opinion received for PCT Patent Application No. PCT/GB2022/050487, mailed on May 23, 2022, 10 pages.
International Search Report and Written Opinion received for PCT Patent Application No. PCT/GB2022/050490, mailed on May 25, 2022, 12 pages.
Search Report received for GB Application No. 2102784.2, mailed on Jul. 28, 2021, 2 pages.

* cited by examiner

FLOOR CLEANER DOCK

CROSS-REFERENCE TO PRIOR APPLICATION

This application is a § 371 National Stage Application of PCT International Application No. PCT/GB2022/050490 filed Feb. 22, 2022, which claims the priority of United Kingdom Application No. 2102784.2, filed Feb. 26, 2021, each of which are herein incorporated by reference in their entirety.

FIELD OF THE INVENTION

This invention relates to a dock for a floor cleaner. More particularly, but not exclusively, this invention relates to a dock for cleaning a floor cleaner.

BACKGROUND OF THE INVENTION

Various types of floor cleaner are available. They include "dry" floor cleaners such as vacuum cleaners, and "wet" floor cleaners. Wet floor cleaners apply a cleaning fluid to the floor as part of the cleaning process. Wet floor cleaners often include a reservoir for holding cleaning fluid, means by which to apply the cleaning fluid to the floor, cleaning pads arranged to be in contact with the floor and for agitating the cleaning fluid once applied to the floor, and potentially a waste liquid reservoir for receiving waste liquid, i.e. the cleaning fluid once it has been in contact with the floor and agitated by the cleaning pads. The wet floor cleaner may also comprise at least one flexible blade, or squeegee, to help contain the cleaning fluid in the cleaning area during the cleaning process. The wet floor cleaner will also often contain a power source, for example a rechargeable battery, which powers some or all of: the application of cleaning fluid to the floor; driving the cleaning pads to agitate the cleaning fluid in contact with the floor; and removing the waste liquid into the waste liquid reservoir as required.

As such, floor cleaners, and in particular wet floor cleaners, may have several service requirements, including but not limited to: refilling cleaning fluid; emptying waste fluid; recharging the power source; conditioning the cleaning pads; and general cleaning and sanitising of the floor cleaner. The present invention seeks to address at least some of these service requirements.

SUMMARY OF THE INVENTION

According to a first aspect, the invention provides a dock for receiving a floor cleaner with a cleaning head, the dock comprising: a receiving unit for receiving the cleaning head of the floor cleaner, a hair removal unit for removing hair from a cleaning head received by the receiving unit.

The floor cleaner may comprise a rotary cleaning head. The floor cleaner may comprise an oscillating cleaning head. In use, the cleaning head of the floor cleaner may pick up hair or other fibrous materials. Such materials may wrap around, or otherwise stick to the cleaning head, potentially leading to a reduced cleaning performance and/or appearing unattractive to a user. Advantageously, the dock provides a hair removal unit for removing hair from the cleaning head of a floor cleaner.

The floor cleaner may be a wet floor cleaner. The floor cleaner may be a dry floor cleaner.

The hair removal unit may comprises a cutter, the cutter arranged to move across a cleaning head received by the receiving unit. The hair removal unit may comprise a hook, the hook arranged to move across a cleaning head received by the receiving unit. The cutter may cut hair which is entangled on the cleaning head, which may make it easier for a hook to remove hair from the cleaning head. In an alternative arrangement, the hook and/or cutter may remain stationary, and the cleaner head may be moved relative to the hook and/or cutter to provide the cutting and hair removal action.

The cutter and hook may be part of the same unitary body. Advantageously, providing a unitary body which forms both the cutter and the hook may simplify the hair removal unit, for example by requiring only a single actuator to move the cutter and hook relative to the cleaning head.

The hair removal unit may comprise a toothed comb, the toothed comb arranged to make contact with a cleaning head received by the receiving unit. The hair removal unit may comprise an actuator for moving the toothed comb relative to a cleaning head received by the receiving unit. In an alternative arrangement, the cleaning head may be arranged to be moved relative to the toothed comb when received by the receiving unit. In another arrangement, both the cleaning head and the toothed comb may be moved during the hair removal process. Relative movement between the toothed comb and the cleaning head may transfer any hair entangled on the cleaning head to the toothed comb.

The hair removal unit may comprise at least one tapered roller, the at least one tapered roller arranged to make contact with and rotate relative to a cleaning head received by the receiving unit. The tapered roller may have a free end, in particular the narrow end of the tapered roller may be a free end. Movement of the tapered roller, when in contact with the cleaning head, may transfer any hair entangled on the cleaning head to the tapered roller. The hair, once transferred to the tapered roller, may migrate to the narrow end of the tapered roller. The hair, once it reaches a narrow free end of the tapered roller, may fall away from the tapered roller.

The hair removal unit may comprise a hair waste bin, for receiving hair removed from a cleaning head received by the receiving unit. The hair waste bin may be removable from the dock for emptying.

The dock may further comprise a charging unit, the charging unit arranged to charge a battery of a floor cleaner received in the receiving unit.

The dock may further comprise a waste liquid reservoir for receiving waste liquid from a floor cleaner received in the receiving unit.

The dock may further comprise a cleaning fluid reservoir for supplying cleaning fluid to a floor cleaner received in the receiving unit.

The dock may further comprise a cleaning head treatment unit. The cleaning head treatment unit may comprise any of a heater, dryer, agitator, sterilising liquid, UV treatment.

According to a second aspect, the invention provides a method of removing hair from the cleaning head of a floor cleaner, the method comprising the steps of: docking the floor cleaner with a dock according to the first aspect of the invention such that the floor cleaner is received in the receiving unit, and activating the hair removal unit.

The hair removal unit may comprise a cutter and hook, and the step of activating the hair removal unit may comprise moving the cutter and hook across the cleaning head of the floor cleaner.

The hair removal unit may comprise a toothed comb, and the step of activating the hair removal unit may comprises generating relative movement between the toothed comb and the cleaning head.

The hair removal unit may comprise at least one tapered roller, and the step of activating the hair removal unit may comprise generating rotational movement of the tapered roller relative to the cleaning head.

It will of course be appreciated that features described in relation to one aspect of the present invention may be incorporated into other aspects of the present invention. For example, the apparatus of the invention may incorporate any of the features described with reference to the method of the invention and vice versa.

DESCRIPTION OF THE DRAWINGS

Embodiments of the present invention will now be described by way of example only with reference to the accompanying schematic drawings of which.

DETAILED DESCRIPTION

Figure 1:
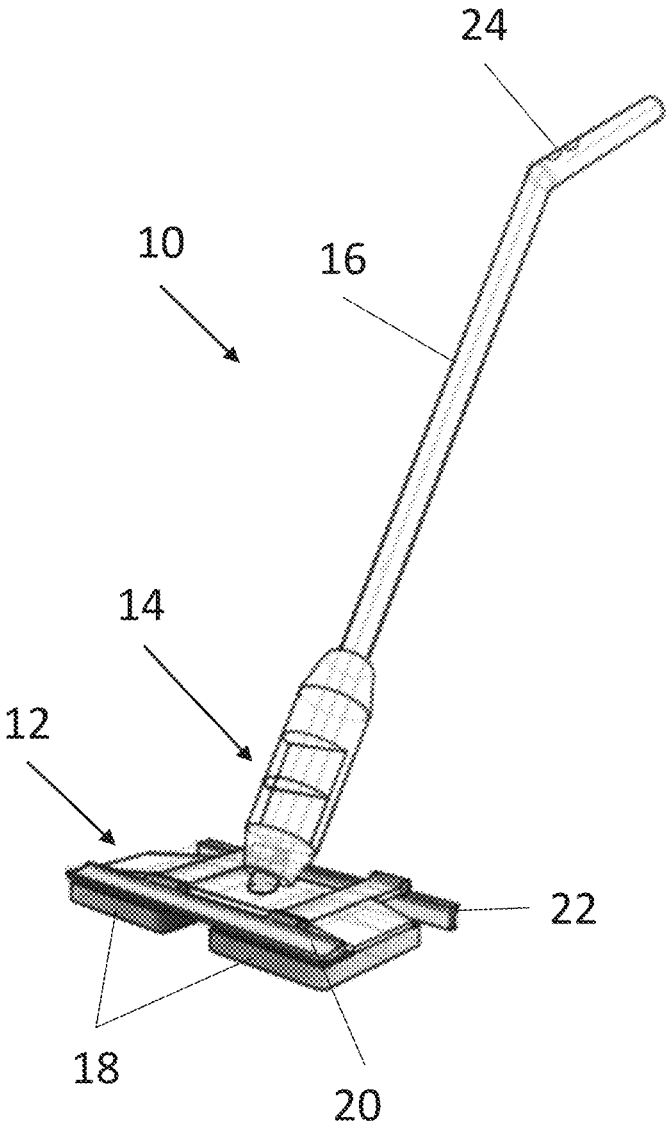
FIG. 1 shows a schematic view of a floor cleaner.

FIG. 1 shows a floor cleaner 10, which comprises a cleaning head 12, a body 14 pivotally attached to the cleaning head 12, and a handle 16 extending away from the body 14. The cleaning head 12 comprises two cleaning pads 18, which are arranged to contact a floor and oscillate during use, and a front squeegee 20 and rear squeegee 22, respectively positioned in front of and behind the cleaning pads 18. The terms "front" and "rear" will be understood by the skilled person to mean the front and rear of the cleaning head 12 when the floor cleaner is being used by a user. In FIG. 1, the front squeegee 20 is shown in a retracted position, and may also be folded down into a deployed position, in which the front squeegee 20 makes contact with the floor. The body 14 comprises a cleaning fluid reservoir, a waste fluid reservoir, and a battery (not shown). The cleaning fluid reservoir is arranged to hold cleaning fluid and apply the cleaning fluid to the floor during use of the floor cleaner 10. The cleaning pads 18 oscillate during use of the floor cleaner, thereby agitating the cleaning fluid on the floor, providing a cleaning effect. The cleaning fluid becomes dirty during agitation, and the waste liquid reservoir is arranged to suck up and store the waste liquid during use of the floor cleaner. The battery is arranged to power the application of cleaning fluid to the floor, the oscillation of the cleaning pads 20, and the sucking up of the waste liquid. The handle 16 comprises a user interface 24 which turns on and off the floor cleaner functions. The skilled person will appreciate that different floor cleaner configurations may be presented, for example a floor cleaner with a rotating rather than an oscillating cleaning pad.

Figure 2:
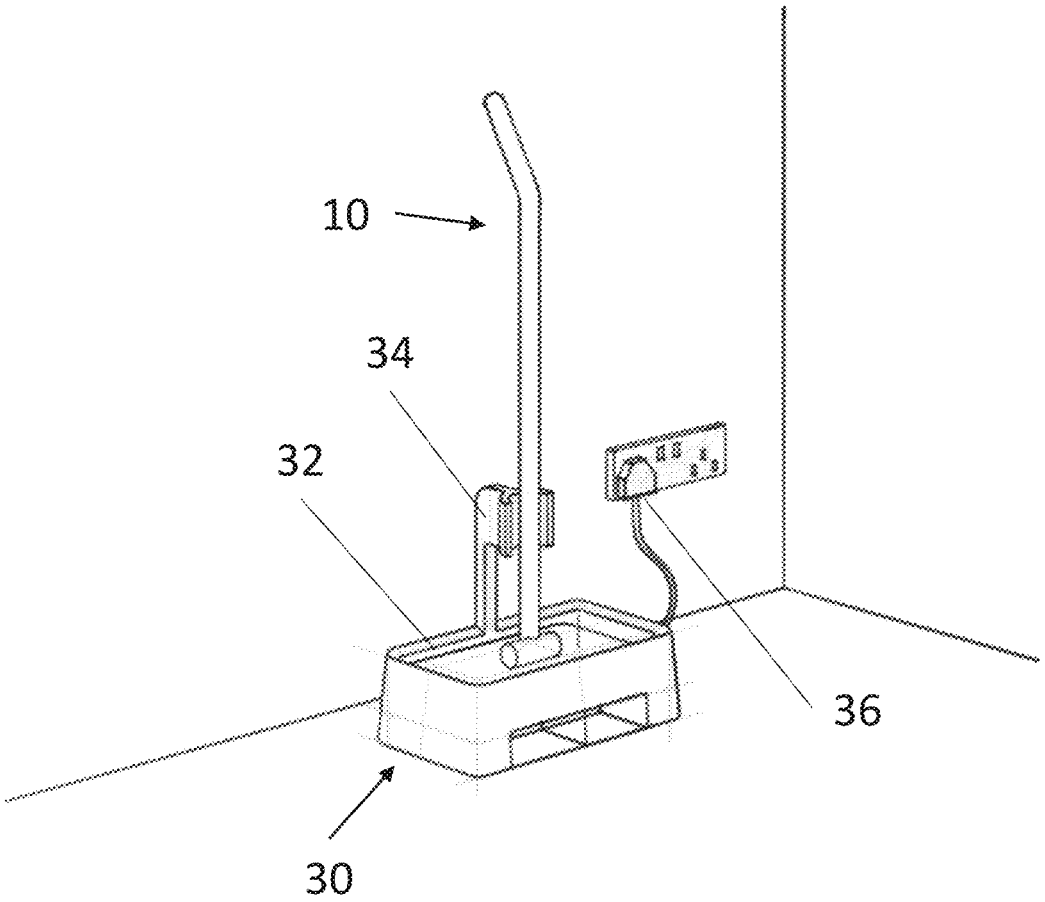
FIG. 2 shows a schematic view of a floor cleaner and dock.

FIG. 2 shows a floor cleaner 10 and a dock 30. The dock 30 comprises a receiving unit 32 which receives the cleaning head 12 of the floor cleaner 10, and a support arm 34 against which the handle 16 of the floor cleaner 10 rests. The dock further comprises a power connection 36 to mains electricity.

Figure 3:
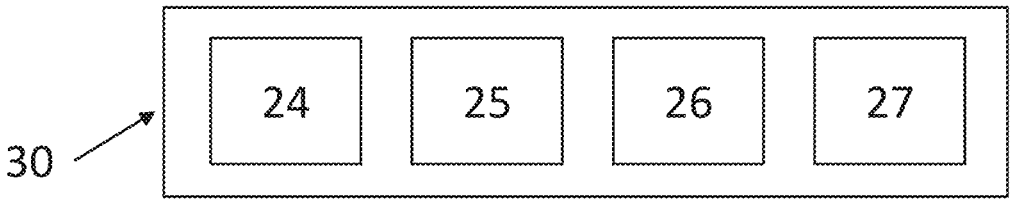
FIG. 3 shows a schematic representation of components of the dock shown in FIG. 2.

FIG. 3 shows some additional components of the dock 30. In particular, the dock 30 comprises a charging unit 24 connected to mains electricity via the power connection 36. The charging unit 24 is arranged to supply charge to battery of the floor cleaner 10, either by wireless charging or by wired charging. The dock 30 also comprises a waste liquid tank 25, a cleaning fluid tank 26, and a control unit 27. The waste liquid tank 25 is arranged to receive waste liquid from the waste liquid reservoir of the floor cleaner 10. The cleaning fluid tank 26 is arranged to feed cleaning fluid into the cleaning fluid reservoir of the floor cleaner 10. The control unit 27 is arranged to control any active service functions of the dock 30, including the charging of the floor cleaner 10. Therefore, the dock 30 is able to perform several service functions on the floor cleaner 10, including charging the floor cleaner 10, emptying waste liquid from the floor cleaner 10, and refilling the floor cleaner 10 with cleaning fluid.

Figure 4:
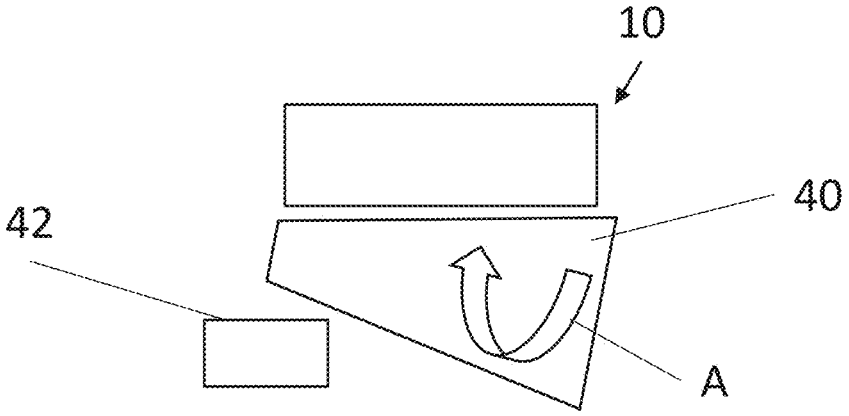
FIG. 4 shows a schematic cross-sectional view of a dock and floor cleaner with a first hair removal unit.

FIG. 4 shows the cleaning head 10 when received in the receiving unit 32. In this embodiment, the receiving unit 32 comprises a hair removal unit in the form of a tapered roller 40, which is arranged to contact the cleaning head 10, and rotate relative to the cleaning head 10 as shown by the arrow A. The narrow end of the tapered roller 40 is a free end, meaning that hair transferred from the cleaning head may migrate along the tapered roller 40 to the free end, at which point the hair will fall from the free end into a hair removal bin 42.

Figure 5:
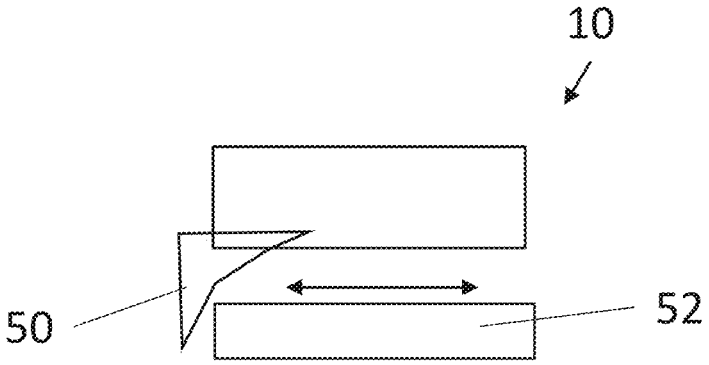
FIG. 5 shows a schematic cross-sectional view of a dock and floor cleaner with a second hair removal unit.

FIG. 5 shows the cleaning head when received in the receiving unit 32. In this embodiment, the receiving unit 32 comprises a hair removal unit in the form of a hook and cutter 50 arranged to be reciprocated across the cleaning head 10. The hook and cutter 50 acts to lift hair from the cleaning head 10 and cut it away. Hair cut from the cleaning head 10 may fall into the hair removal bin 52.

Figure 6:
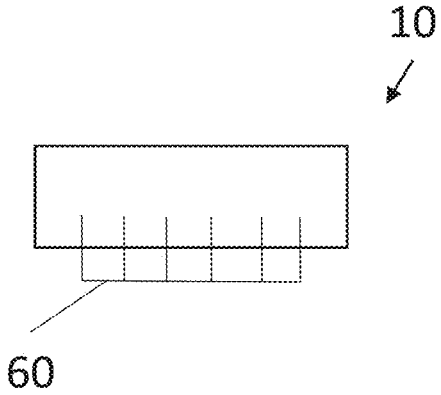
FIG. 6 shows a schematic cross-sectional view of a dock and floor cleaner with a third hair removal unit.

FIG. 6 shows the cleaning head when received in the receiving unit 32. In this embodiment, the receiving unit 32 comprises a hair removal unit in the form of a toothed comb 60, which contacts cleaning 10. The cleaning head 10 and toothed comb move relative to one another, either by actuation of the cleaning head 10, the toothed comb 60, or both. Hair entangled on the cleaning 10 is thereby transferred to the toothed comb 60. The toothed comb 60 may be removed from the receiving unit 32 to removed hair that has been transferred from the cleaning head 10, or there may be a scraper associated with the toothed comb 60 which scrapes the hair into a hair removal bin (not shown).

Whilst the present invention has been described and illustrated with reference to particular embodiments, it will be appreciated by those of ordinary skill in the art that the invention lends itself to many different variations not specifically illustrated herein.

Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A method of removing hair from a cleaning head of a floor cleaner, the method comprising the steps of:

docking the floor cleaner with a dock such that the cleaning head is received in a receiving unit of the dock;

wherein the dock comprises:

a hair removal unit for removing hair from the cleaning head received by the receiving unit, wherein the hair removal unit comprises a tapered roller configured to rotate about a rotational axis and relative to the cleaning head; and activating the hair removal unit, resulting in rotation of the tapered roller about the rotational axis to remove hair from the cleaning head of the floor cleaner, wherein the tapered roller has opposite, first and second ends spaced from one another along the rotational axis and an outer peripheral surface extending therebetween, wherein an outer diameter of the tapered roller decreases along the rotational axis in a direction from the first end to the second end.

2. The method as claimed in claim 1, wherein the dock further comprises a waste liquid reservoir for receiving waste liquid from the floor cleaner received in the receiving unit.

3. The method as claimed in claim 1, wherein the dock further comprises a cleaning fluid reservoir for supplying cleaning fluid to the floor cleaner received in the receiving unit.

4. The method as claimed in claim 1, wherein the dock further comprises a cleaning head treatment unit configured to dry, clean, and/or provide microbial treatment action to the cleaning head.

5. The method as claimed in claim 1, wherein the hair accumulated on the tapered roller, after being transferred from the cleaning head, migrates to the second end of the tapered roller.

6. The method as claimed in claim 1, wherein the dock further comprises:

a waste liquid reservoir for receiving waste liquid from the floor cleaner; and a cleaning fluid reservoir for supplying cleaning fluid to the floor cleaner, and wherein after docking the floor cleaner with the dock, the method further comprises the step of:

receiving, in the waste liquid reservoir, the waste liquid from the floor cleaner; and supplying, from the cleaning fluid reservoir, the cleaning fluid to the floor cleaner.

7. The method as claimed in claim 1, wherein the cleaning head extends lengthwise along a longitudinal axis, and wherein the rotational axis is offset from the longitudinal axis.

8. The method as claimed in claim 1, wherein activating the hair removal unit results in the outer peripheral surface of the tapered roller contacting the cleaning head.

9. The method as claimed in claim 1, wherein the dock comprises a hair removal bin disposed adjacent the second end, wherein the second end is a free end.

10. The method as claimed in claim 5, wherein the second end of the tapered roller is a free end.

11. The method as claimed in claim 5, wherein the hair that migrates to the second end falls therefrom into a removal bin.

12. The method as claimed in claim 7, wherein the rotational axis is angled relative to the longitudinal axis.

13. The method as claimed in claim 9, wherein the method comprises transferring said hair from the tapered roller to the hair removal bin via said hair migrating along the tapered roller to the second end and falling into the hair removal bin.

* * * * *